US010043602B2

(12) United States Patent
Matsumoto

(10) Patent No.: US 10,043,602 B2
(45) Date of Patent: Aug. 7, 2018

(54) CHIP RESISTOR

(71) Applicant: KOA Corporation, Ina-shi, Nagano (JP)

(72) Inventor: Kentaro Matsumoto, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/523,019

(22) PCT Filed: Aug. 25, 2015

(86) PCT No.: PCT/JP2015/073882
§ 371 (c)(1),
(2) Date: Apr. 28, 2017

(87) PCT Pub. No.: WO2016/067726
PCT Pub. Date: May 6, 2016

(65) Prior Publication Data

US 2017/0316853 A1 Nov. 2, 2017

(30) Foreign Application Priority Data

Oct. 31, 2014 (JP) ..... 2014-223128

(51) Int. Cl.
*H01C 1/142* (2006.01)
*H01C 1/012* (2006.01)
(Continued)

(52) U.S. Cl.
CPC ..... *H01C 1/142* (2013.01); *H01C 1/012* (2013.01); *H01C 17/006* (2013.01); *H01C 17/242* (2013.01); *H01C 17/281* (2013.01)

(58) Field of Classification Search
CPC ..... H01C 1/142; H01C 1/012; H01C 17/006; H01C 17/242
(Continued)

(56) References Cited

U.S. PATENT DOCUMENTS 5,258,738 A * 11/1993 Schat ..... H01C 1/144 338/20
8,193,899 B2 * 6/2012 Takeuchi ..... H01C 1/06 338/262
2008/0211619 A1 * 9/2008 Belman ..... H01C 17/288 338/309

FOREIGN PATENT DOCUMENTS

JP 2001-148302 A 5/2001
JP 2009-43883 A 2/2009
(Continued)

OTHER PUBLICATIONS

International Search Report (PCT/ISA/210) issued in PCT Application No. PCT/JP2015/073882 dated Nov. 10, 2015 with English translation (Four (4) pages).
(Continued)

*Primary Examiner* — Kyung Lee
*Assistant Examiner* — Iman Malakooti
(74) *Attorney, Agent, or Firm* — Crowell & Moring LLP

(57) ABSTRACT

To provide a chip resistor in which a resistive element can be surely protected from an external environment and which is also excellent in corrosion resistance, a chip resistor 1 is configured to include an insulating substrate 2, a pair of front electrode 3 provided on opposite end portions of a front surface of the insulating substrate 2, a pair of back electrodes 7 provided on opposite end portions of a back surface of the insulating substrate 2, a resistive element 4 provided to extend onto the two front electrodes 3, a first insulating layer 5 covering the resistive element 4, a second insulating layer 6 made of a resin material to cover the first insulating layer 5, end surface electrodes 8 establishing electrical continuity between the front electrodes 3 and the back electrodes 7, plating layers 9 covering the end surface electrodes 8, etc. Rough surface portions 6*a* made rougher in surface roughness than any other portion of the second insulating layer 6
(Continued)

are formed at opposite end portions of the second insulating layer 6. End portions of the end surface electrodes 8 and the plating layers 9 are brought into tight contact with the rough surface portions 6*a* respectively.

5 Claims, 4 Drawing Sheets

(51) Int. Cl.
*H01C 17/00* (2006.01)
*H01C 17/242* (2006.01)
*H01C 17/28* (2006.01)
(58) Field of Classification Search
USPC ..... 338/307, 309, 332
See application file for complete search history.

(56) References Cited

FOREIGN PATENT DOCUMENTS

| | | | |
|---|---|---|---|
| JP | 2009-158721 | A | 7/2009 |
| JP | 2013-219387 | A | 10/2013 |

OTHER PUBLICATIONS

Japanese-language Written Opinion Report (PCT/ISA/237) issued in PCT Application No. PCT/JP2015/073882 dated Nov. 10, 2015 (Three (3) pages).

* cited by examiner

CHIP RESISTOR

TECHNICAL FIELD

The present invention relates to a surface mount type chip resistor.

BACKGROUND ART

Generally, a chip resistor is mainly constituted by a cuboid-shaped insulating substrate, a pair of front electrodes, a pair of back electrodes, end surface electrodes, plating layers, a resistive element, a protective layer, etc. The pair of front electrodes are disposed on a front surface of the insulating substrate and face each other with a predetermined interval therebetween. The pair of back electrodes are disposed on aback surface of the insulating substrate and face each other with a predetermined interval therebetween. The end surface electrodes establish electrical continuity between the front electrodes and the back electrodes respectively. The plating layers cover the electrodes. The resistive element bridges the front electrodes paired with each other. The protective layer covers the resistive element. The protective layer has a two-layer structure consisting of a first insulating layer called an undercoat layer and a second insulating layer called an overcoat layer.

In chip resistors configured thus, laser light is applied to resistive elements to form trimming grooves therein. In this manner, initial resistance values which have been varied among the resistive elements in a production stage are adjusted to a target desired resistance value. In order to prevent the vicinity of the trimming groove of each of the resistive elements from being damaged by heat of the laser light on this occasion, the resistive element is covered with a first protective layer made of a glass material so that the resistive element can be irradiated with the laser light through the first protective layer. In addition, the resistive element in which the trimming groove has been formed is protected from an external environment by a second protective layer. When the second protective layer is formed of a glass material excellent in humidity resistance, the glass is required to be sintered at a high temperature of about 600° C. Therefore, there is a disadvantage that the adjusted resistance value changes to prevent the resistive element from being produced with high accuracy. To solve the disadvantage, a method for sintering a resin material such as an epoxy resin at a relatively low temperature of about 200° C. to form the second protective layer has become the mainstream recently. A contrivance has been also made as follows. That is, an epoxy resin, a polyimide resin, or the like, excellent in humidity resistance is used as the resin material to form the second protective layer which is so dense not to contain any void or any air hole.

In addition, this type of chip resistor has a configuration in which an Ag-based metal material is normally used as front electrodes and plating layers are formed to cover the front electrodes. However, a sulfide gas etc. strong in corrosiveness infiltrates gaps as boundary portions between the plating layers and a second protective layer easily. For this reason, there is a fear that the front electrodes may be corroded by the sulfide gas etc. to cause problems about a change in resistance value, disconnection, etc.

To solve the problems, the following chip resistor has been heretofore proposed, as disclosed in Patent Literature 1. That is, end surface electrodes are formed to extend up to end portions of a second protective layer, and plating layers formed on the end surface electrodes are brought into tight contact with the end portions of the second protective layer. Thus, gaps between the second protective layer and the end surface electrodes can be eliminated so as to improve corrosion resistance (particularly sulfurization resistance).

CITATION LIST

Patent Literature

Patent Literature 1: JP-A-2009-158721

SUMMARY OF INVENTION

Technical Problem

However, when the second protective layer is formed into a dense structure in order to improve humidity resistance, a front surface of the second protective layer is smooth with surface roughness having no void or air hole. Accordingly, tight contact properties of the end surface electrodes or the plating layers with the second protective layer are degraded to make the end surface electrodes or the plating layers be peeled off the second protective layer easily. As a result, there arises a problem that corrosion resistance of front electrodes may be spoiled.

The invention has been accomplished in consideration of the actual circumstances of the aforementioned background-art technique. An object of the invention is to provide a chip resistor in which a resistive element can be surely protected from an external environment and which is also excellent in corrosion resistance.

Solution to Problem

In order to achieve the aforementioned object, the invention provides a chip resistor including: a cuboid-shaped insulating substrate; a pair of front electrodes which are provided on opposite end portions of a front surface of the insulating substrate; a pair of back electrodes which are provided on opposite end portions of a back surface of the insulating substrate; a resistive element which is provided to extend onto the pair of front electrodes; a first insulating layer which is made of a glass material to cover the resistive element; a second insulating layer which is made of a resin material to cover portions of the front electrodes and the first insulating layer; end surface electrodes which are provided to establish electrical continuity between the front electrodes and the back electrodes and which extend beyond boundary positions between the front electrodes and the second insulating layer and up to end portions of the second insulating layer; and plating layers which are provided to cover the end surface electrodes and which extend beyond boundary positions between the end surface electrodes and the second insulating layer and up to the end portions of the second insulating layer, a trimming groove being formed in the resistive element and the first insulating layer so that a resistive value of the chip resistor can be adjusted; wherein: rough surface portions made rougher in surface roughness than any other portion of the second insulating layer are provided at opposite end portions of the second insulating layer positioned on outer sides of the trimming groove; and end portions of the end surface electrodes and the plating layers are in tight contact with the rough surface portions respectively.

In the chip resistor configured thus, the front surface of the second insulating layer covering the portion where the trimming groove is present has denser surface roughness than the opposite end portions of the second insulating layer. Accordingly, humidity resistance can be secured so that the resistive element can be surely protected from an external environment. In addition, the opposite end portions of the second insulating layer covering the portions where the trimming groove is absent serve as the rough surface portions whose surfaces are roughened. The end portions of the end surface electrodes and the plating layers reach the rough surface portions. Accordingly, tight contact properties of the end surface electrodes and the plating layers with the second insulating layer are so excellent that corrosion resistance of the front electrodes can be surely prevented from being spoiled.

In the aforementioned configuration, the rough surface portions may be formed by blast treatment applied to the second insulating layer. Thus, the rough surface portions and the other portion can be formed in the second insulating layer made of one and the same material.

Alternatively, auxiliary insulating layers made rougher in surface roughness than the second insulating layer may be provided on the opposite end portions of the second insulating layer, and the auxiliary insulating layers can be formed as the rough surface portions. In this case, the auxiliary insulating layers can be formed by printing in a simpler production process than by the blast treatment.

In this case, a resin material of the auxiliary insulating layers may contain the same material as a material used for the end surface electrodes. Thus, tight contact properties between the end surface electrodes and the auxiliary insulating layers (rough surface portions) can be preferably enhanced more greatly.

In addition, in the aforementioned configuration, the plating layers may be formed of the same material as the material contained in the end surface electrodes and the auxiliary insulating layers. Thus, not only tight contact properties between the end surface electrodes and the auxiliary insulating layers but also tight contact properties between the plating layers and the auxiliary insulating layers can be preferably enhanced.

Advantageous Effects of Invention

According to the invention, the opposite end portions of the second insulating layer covering the portions where the trimming groove is absent are formed as the rough surface portions so that tight contact properties of the end surface electrodes or the plating layers with the second insulating layer can be excellent. Consequently, it is possible to provide a chip resistor in which a resistive element can be surely protected from an external environment and which is also excellent in corrosion resistance.

DESCRIPTION OF EMBODIMENTS

Figure 1:
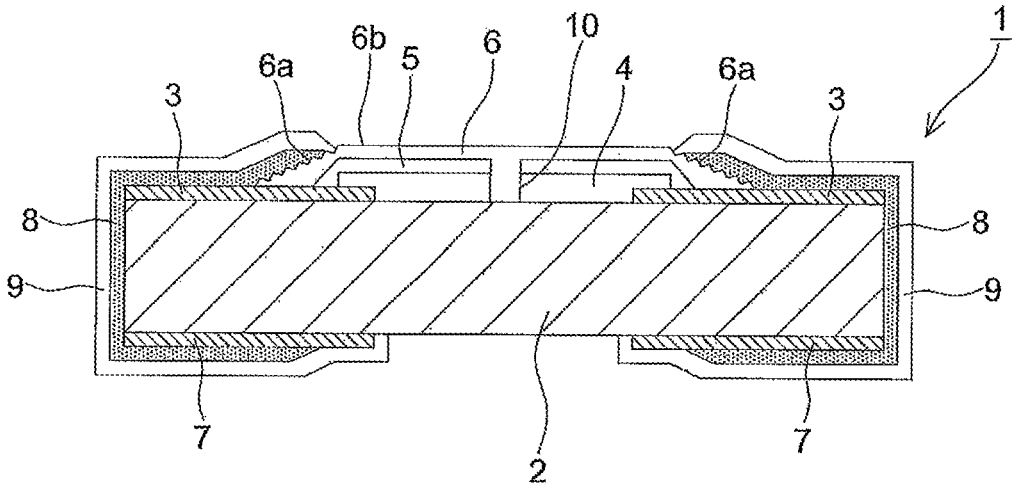
FIG. 1 A sectional view of a chip resistor according to a first embodiment of the invention.
Figure 2A:
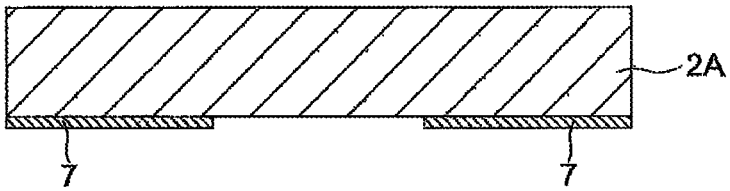
FIGS. 2A-2F Sectional views showing production steps of the chip resistor.
Figure 2B:
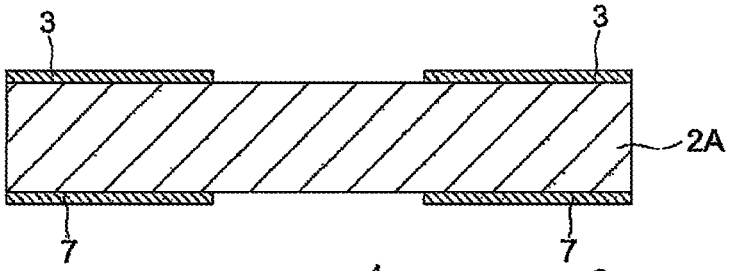
Figure 2C:
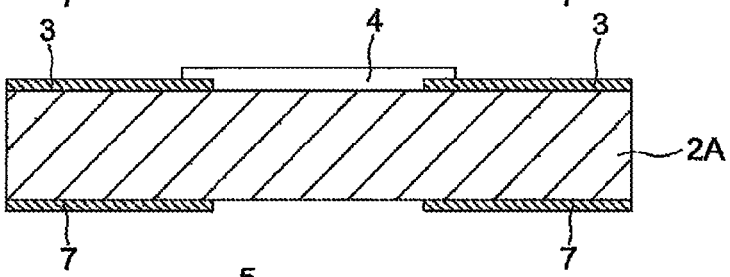
Figure 2D:
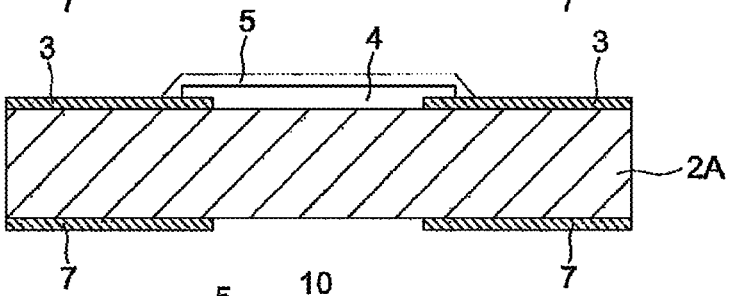
Figure 2E:
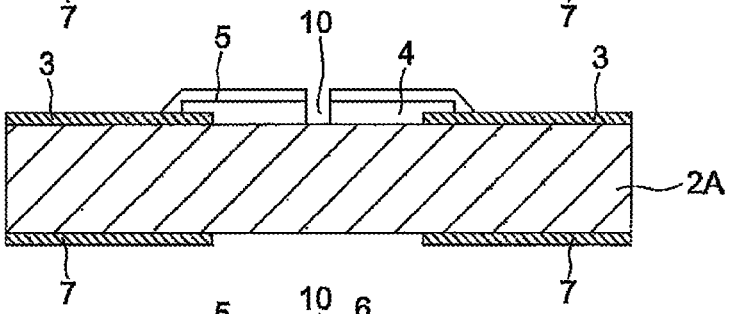
Figure 2F:
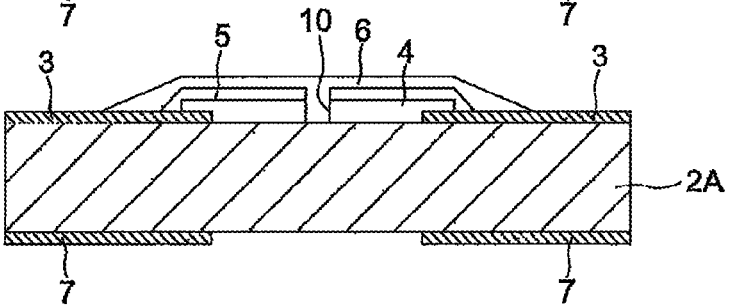
Figure 3A:
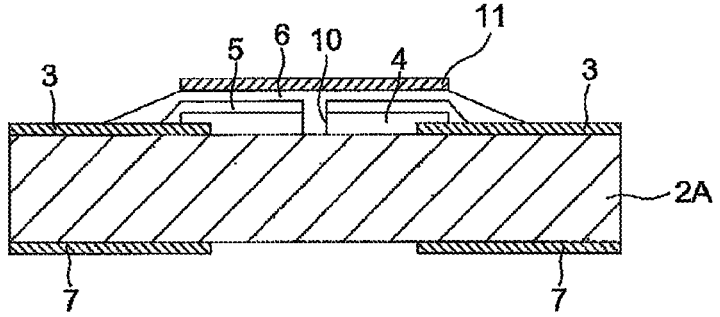
FIGS. 3A-3E Sectional views showing production steps of the chip resistor.
Figure 3B:
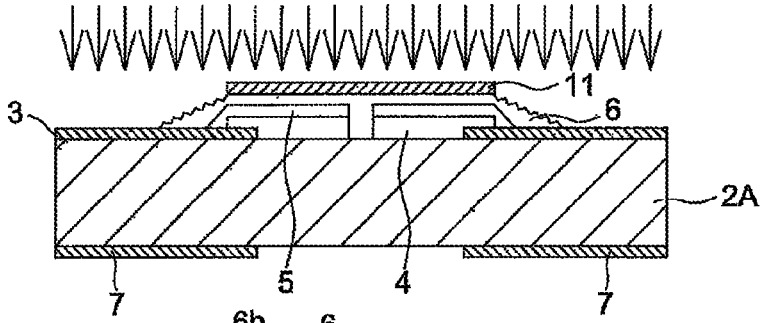
Figure 3C:
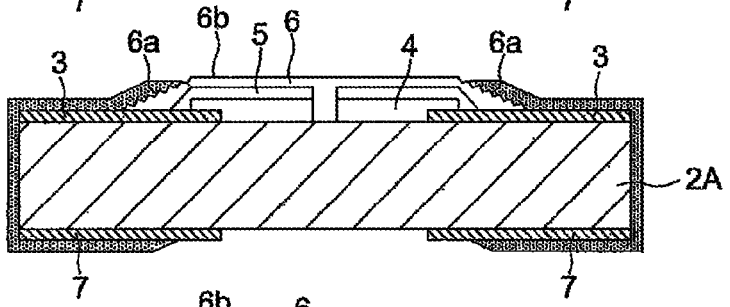
Figure 3D:
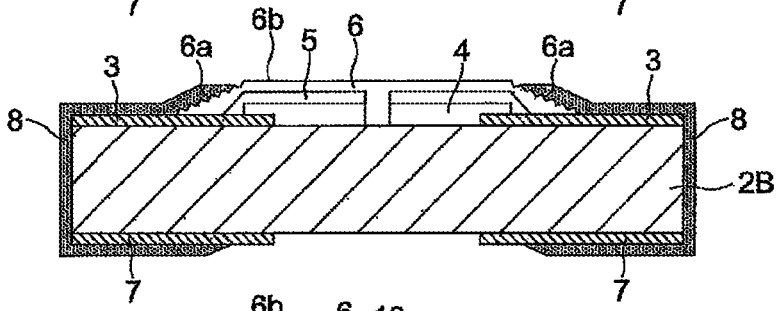
Figure 3E:
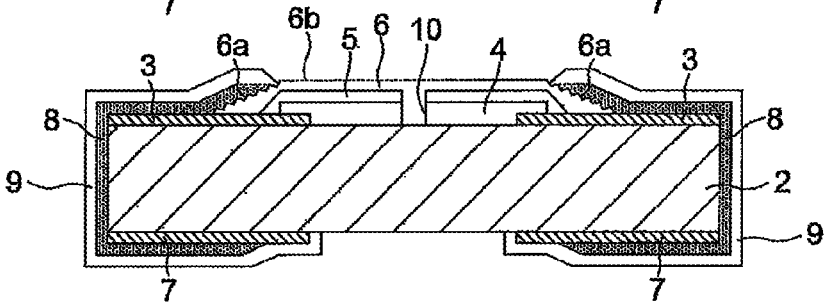

Embodiments of the invention will be described below with reference to the drawings. As shown in FIG. 1, a chip resistor 1 according to a first embodiment of the invention is mainly constituted by a cuboid-shaped insulating substrate 2, a pair of front electrodes 3, a resistive element 4, a first insulating layer 5, a second insulating layer 6, a pair of back electrodes 7, a pair of end surface electrodes 8, plating layers 9, etc. The pair of front electrodes 3 are provided on longitudinally opposite end portions in an upper surface of the insulating substrate 2. The resistive element 4 shaped like a rectangle is provided to extend onto the front electrodes 3. The first insulating layer 5 covers the resistive element 4. The second insulating layer 6 covers the first insulating layer 5. The pair of back electrodes 7 are provided on longitudinally opposite end portions in a lower surface of the insulating substrate 2. The pair of end surface electrodes 8 are provided on side surfaces of the insulating substrate 2 to establish electrical continuity between the front electrodes 3 and the back electrodes 7 correspondingly and respectively. The plating layers 9 cover the end surface electrodes 8. A trimming groove 10 is formed in the resistive element 4 and the first insulating layer 5. A resistance value of the resistive element 4 is adjusted by the trimming groove 10.

The insulating substrate 2 is made of ceramics etc. When a large-sized aggregate substrate which will be described later is divided along primary division grooves and secondary division grooves which extend vertically and horizontally, a number of the insulating substrates 2 can be obtained.

The front electrodes 3 are obtained by screen-printing, drying and sintering an Ag (silver)-based paste material containing 1 to 5 wt % Pd (palladium).

The resistive element 4 is obtained by screen-printing, drying and sintering a resistive paste of ruthenium oxide etc. Longitudinally opposite end portions of the resistive element 4 overlap with the front electrodes 3.

The first insulating layer 5 and the second insulating layer 6 form a protective layer having a two-layer structure. Of the protective layer, the first insulating layer 5 is an undercoat layer which covers the resistive element 4 before the trimming groove 10 is formed, and the second insulating layer 6 is an overcoat layer which covers the first insulating layer 5 after the trimming groove 10 is formed. Incidentally, the trimming groove 10 is a slit which is formed into an L-shape, a linear shape or the like by irradiation of laser light. The slit is formed within a region of the resistive element 4 interposed between the pair of front electrodes 3.

The first insulating layer 5 is obtained by screen-printing, drying and sintering a glass paste. The first insulating layer 5 covers an upper surface of the resistive element 4 and overlaps with end portions of the front electrodes 3.

The second insulating layer 6 is obtained by screen-printing and thermally curing (baking) an epoxy resin paste or an epoxy resin-based paste containing polyimide, which is excellent in humidity resistance. The second insulating layer 6 covers the first insulating layer 5 and overlaps with the end portions of the front electrodes 3. Opposite end portions of the second insulating layer 6 serve as rough surface portions 6*a*. The rough surface portions 6*a* are set to be rougher in surface roughness than any other portion of the second insulating layer 6. That is, the portion of the second insulating layer 6 excluding the rough surface portions 6*a* has smooth surface roughness with no void or air hole. Call the portion a smooth surface portion 6*a*. Ra (arithmetic average roughness) of each of the rough surface portions 6*a* is set to be 1.5 times or more as high as that of the smooth surface portion 6*a*. Incidentally, as will be described later in detail, the rough surface portion 6*a* is formed by shot blast such as sand blast applied to a front surface of the second insulating layer 6.

The back electrodes 7 are obtained by screen-printing, drying and sintering an Ag paste or an Ag—Pd paste containing a small amount of Pd.

The end surface electrodes 8 are formed by sputtering nickel (Ni)/chromium (Cr) etc. Most parts of the front electrodes 3 and the back electrodes 7 positioned outside the second insulating layer 6 are covered with the end surface electrodes 8. The end surface electrodes 8 extend beyond boundary portions between the front electrodes 3 and the second insulating layer 6 and up to the rough surface portions 6*a*. Most parts of the rough surface portions 6*a* excluding their upper portion sides are in tight contact with end portions of the end surface electrodes 8.

The plating layers are made of Ni plating, Sn plating, etc. The plating layers 9 cover the end surface electrodes 8, the front electrodes 3 and the back electrodes 7.

Next, a method for producing the chip resistor 1 configured as described above will be described with reference to FIG. 2 and FIG. 3.

First, an aggregate substrate 2A in which primary division grooves and secondary division grooves extending in a latticed pattern have been formed is prepared. Front and back surfaces of the aggregate substrate 2A are sectioned into a number of chip formation regions by the primary division grooves and the secondary division grooves. Each of the chip formation regions serves as an insulating substrate 2 corresponding to one chip resistor. Although one chip formation region is representatively shown in FIG. 2 and FIG. 3, a number of such chip formation regions are actually arrayed in the latticed pattern.

An Ag paste is screen-printed on the back surface of the aggregate substrate 2A, and then dried. Thus, as shown in FIG. 2(*a*), a pair of back electrodes 7 facing each other with a predetermined interval therebetween are formed on longitudinally opposite end portions of each chip formation region.

Next, an Ag—Pd paste is screen-printed on the front surface of the aggregate substrate 2A, and then dried. Thus, as shown in FIG. 2(*b*), a pair of front electrodes 3 facing each other with a predetermined interval therebetween are formed on longitudinally opposite end portions of each chip formation region. Then, the front electrodes 3 and the back electrodes 7 are sintered simultaneously at a high temperature of about 850° C. Incidentally, the front electrodes 3 and the back electrodes 7 may be sintered separately, or a formation sequence of the front electrodes 3 and the back electrodes 7 may be reversed so as to form the front electrodes 3 prior to the back electrodes 7.

Next, a resistive paste containing ruthenium oxide etc. is screen-printed on the front surface of the aggregate substrate 2A, and then dried. Thus, a resistive element 4 whose end portions are superimposed on the front electrodes 3 is formed as shown in FIG. 2(*c*), and then sintered at a high temperature of about 850° C.

Next, a glass paste is screen-printed on a region covering the resistive element 4, and then dried. Thus, a first insulating layer 5 covering the resistive element 4 and end portions of the front electrodes 3 is formed as shown in FIG. 2(*d*), and then sintered at a temperature of about 600° C.

Next, laser light is applied to the resistive element 4 through the first insulating layer 5 while probes not shown are brought into contact with the pair of auxiliary electrodes 5 respectively to measure a resistance value of the resistive element 4. Thus, as a shown in FIG. 2(*e*), a trimming groove 10 is formed in the first insulating layer 5 and the resistive element 4 to adjust the resistance value of the resistive element 4.

Next, an epoxy-polyimide resin paste is screen-printed to cover the first insulating layer 5, and then thermally cured (baked) at a temperature of about 200° C. Thus, as shown in FIG. 2(*f*), a second insulating layer 6 covering the entire first insulating layer 5, the trimming groove 10 formed in the resistive element 4, and the end portions of the front electrodes 3 is formed.

Next, a masking paste which can be washed away by water etc. is screen-printed on a front surface of the second insulating layer 6, and then dried. Thus, as shown in FIG. 3(*a*), a masking 11 is formed on the second insulating layer 6 excluding its opposite end portions, that is, a portion covering the trimming groove 10.

Next, as shown in FIG. 3(*b*), an abrasive is sprayed by compressed air to apply shot blast to the second insulating layer 6 so as to roughen the front surface of the second insulating layer 6 which is not covered with the masking 11. Then, the masking 11 is cleaned and removed, as shown in FIG. 3(*c*). Thus, rough surface portions 6*a* whose surface have been roughened are formed at opposite end portions of the second insulating layer 6. An upper surface of the second insulating layer 6 which had been covered with the masking 11 becomes a smooth surface portion 6*b* which is smooth with a dense structure.

The steps performed so far are batch processing on the aggregate substrate 2A. In a next step, the aggregate substrate 2A is primarily divided into strips along the primary division grooves, so as to obtain strip-shaped substrates 2B each having a width in the longitudinal direction of the chip formation region.

Ni/Cr is sputtered on divided surfaces of each of the strip-shaped substrates 2B. Thus, as shown in FIG. 3(*d*), a pair of end surface electrodes 8 establishing electrical continuity between the front electrodes 3 and the back electrodes 7 are formed. On this occasion, the end surface electrodes 8 are formed to extend beyond boundary portions between the front electrodes 3 and the second insulating layer 6 and up to the rough surface portions 6*a* of the second insulating layer 6. However, the front surfaces of the rough surface portions 6*a* which have been subjected to blast treatment have uneven surface roughness. Accordingly, tight contact properties between the end surface electrodes 8 and the rough surface portions 6*a* can be enhanced although the resin material excellent in humidity resistance is used to form the second insulating layer 6.

Next, the strip-shaped substrate 2B is secondarily divided along the secondary division grooves, so as to obtain single chips (individual pieces) each having an equal size to the chip resistor 1. Then, Ni plating and Sn plating are sequentially applied to the entire end surface electrodes 8 and portions of the back electrodes 7 in each single chip. Thus, as shown in FIG. 3(*e*), plating layers 9 having a layered structure to cover the end surface electrodes 8 and the back electrodes 7 are formed. Consequently, the chip resistor 1 is completed.

As described above, in the chip resistor 1 according to the embodiment, the front surface of the second insulating layer 6 covering the portion where the trimming groove 10 is present serves as the smooth surface portion 6*b* having dense surface roughness. Accordingly, humidity resistance can be secured so that the resistive element 4 can be surely protected from an external environment. In addition, the opposite end portions of the second insulating layer 6 covering the portions from which the trimming groove 10 is absent serve as the rough surface portions 6*a* whose surfaces have been roughened. The end portions of the end surface electrodes 8 and the plating layers 9 which cover the front electrodes 3 extend up to the rough surface portions 6*a*. Accordingly, tight contact properties of the end surface electrodes 8 and the plating layers 9 with the second insulating layer 6 are so excellent that corrosion resistance of the front electrodes 3 can be surely prevented from being spoiled although the resin material excellent in humidity resistance is used to form the second insulating layer 6.

Figure 4:
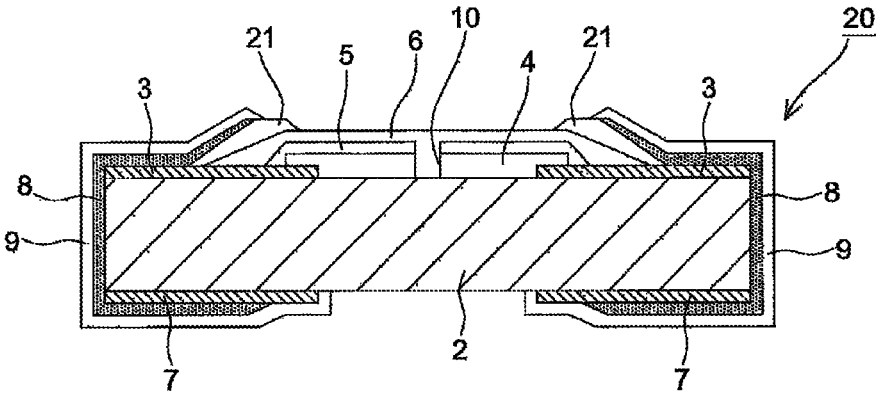
FIG. 4 A sectional view of a chip resistor according to a second embodiment of the invention.

FIG. 4 is a sectional view of a chip resistor 20 according to a second embodiment of the invention. Portions corresponding to those in FIG. 1 are referred to by the same signs respectively.

The chip resistor 20 according to the second embodiment is different from the chip resistor 1 according to the first embodiment in a point that auxiliary insulating layers 21 are provided on opposite end portions of a second insulating layer 6 and the auxiliary insulating layers 21 are formed as rough surface portions. The remaining configuration of the chip resistor 20 according to the second embodiment is basically the same as that of the chip resistor 1 according to the first embodiment.

That is, as shown in FIG. 4, the second insulating layer 6 is obtained by screen-printing and thermally curing an epoxy resin paste or an epoxy resin-based paste containing polyimide, which is excellent in humidity resistance. The second insulating layer 6 covers a first insulating layer 5 and overlaps with end portions of front electrodes 3. The auxiliary insulating layers 21 are provided on the opposite end portions of the second insulating layer 6. Surface roughness Ra of the auxiliary insulating layers 21 is set to be 1.5 times or more as high as that of the second insulating layer 6. The auxiliary insulating layers 21 are obtained by screen-printing and thermally curing an epoxy resin paste rougher in surface roughness than the second insulating layer 6, or an epoxy resin paste added with electrically conductive particles of Ni, Cu, etc. whose amount is so small that the auxiliary insulating layers 21 are not electrically conductive.

End surface electrodes 8 are formed by sputtering Ni/Cu etc. The end surface electrodes 8 extend beyond the front electrodes 3 and up to the middle of the auxiliary insulating layers 21. Here, as long as the additive contained in the resin material of the auxiliary insulating layers 21 is the same as the material used for the end surface electrodes 8, for example, as long as the resin material of the auxiliary insulating layers 21 contains at least one of Ni and Cu when the end surface electrodes 8 are formed by sputtering Ni/Cr, tight contact properties between the end surface electrodes 8 and the auxiliary insulating layers 21 can be extremely excellent.

Plating layers 9 are made of Ni plating, Sn plating, etc. deposited on the end surface electrodes 8 and portions of back electrodes 7. End portions of the plating layers 9 extend beyond the end surface electrodes 8 and up to the auxiliary insulating layers 21. Here, as long as the plating layers 9 are formed of the same material as the material contained in the end surface electrodes 8 and the auxiliary insulating layers 21, for example, as long as at least Ni plating is applied to form the plating layers 9 when Ni is contained in both the end surface electrodes 8 and the auxiliary insulating layers 21, not only can tight contact properties between the end surface electrodes 8 and the auxiliary insulating layers 21 be enhanced but tight contact properties between the plating layers 9 and the auxiliary insulating layers 21 can be also extremely excellent.

Figure 5A:
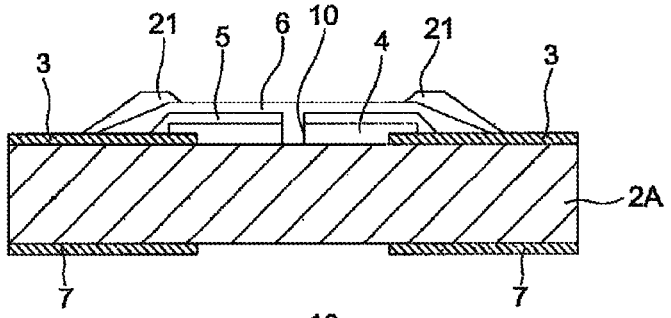
FIGS. 5A-5C Sectional views showing production steps of the chip resistor.
Figure 5B:
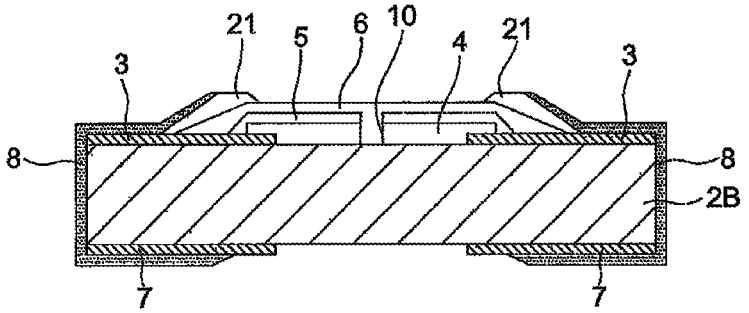
Figure 5C:
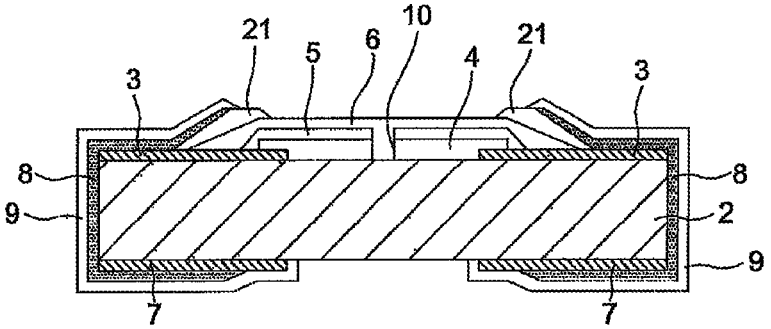

Next, a method for producing the chip resistor 20 configured as described above will be described with reference to FIG. 5. Incidentally, in the method for producing the chip resistor 20, steps up to formation of a second insulating layer 6 shown in FIGS. 2(*a*) to 2(*f*) are the same as those in the first embodiment. FIG. 5 show steps following that.

That is, in the method for producing the chip resistor 20 according to the second embodiment, an epoxy resin paste containing a small amount of Ni is screen-printed and thermally cured (baked) at a temperature of about 200° C. in place of shot blast applied to opposite end portions of the second insulating layer 6. Thus, as shown in FIG. 5(*a*), auxiliary insulating layers (rough surface portions) 21 which are made rougher in surface roughness than the second insulating layer 6 are formed on the opposite end portions of the second insulating layer 6.

Next, an aggregate substrate 2A is primarily divided so as to obtain strip-shaped substrates 2B. Then, Ni/Cr is sputtered on divided surfaces of each of the strip-shaped substrates 2B. Thus, as shown in FIG. 5(*b*), a pair of end surface electrodes 8 establishing electrical continuity between front electrodes 3 and back electrodes 7 are formed. On this occasion, the end surface electrodes 8 are formed to extend beyond the front electrodes 3 and up to the auxiliary insulating layers 21. However, the auxiliary insulating layers 21 serve as rough surface portions which are rough in surface roughness. Accordingly, tight contact properties between the end surface electrodes 8 and the auxiliary insulating layers 21 can be enhanced although the resin material excellent in humidity resistance is used to form the second insulating layer 6.

Next, the strip-shaped substrate 2B is secondarily divided so as to obtain single chips. Then, Ni plating and Sn plating are sequentially applied to the entire end surface electrodes 8 and portions of the back electrodes 7 in each single chip. Thus, as shown in FIG. 5(*c*), plating layers 9 having a layered structure to cover the end surface electrodes 8 and the back electrodes 7 are formed. Consequently, the chip resistor 20 is completed.

As described above, in the chip resistor 20 according to the embodiment, the auxiliary insulating layers 21 made rougher in surface roughness than the second insulating layer 6 are provided on the opposite end portions of the second insulating layer 6, and end portions of the end surface electrodes 8 and the plating layers 9 are brought into tight contact with the auxiliary insulating layers 21. Accordingly, tight contact properties of the end surface electrodes 8 and the plating layers 9 with the auxiliary insulating layers 21 are so excellent that corrosion resistance of the front electrodes 3 can be surely prevented from being spoiled although the resin material excellent in humidity resistance is used to form the second insulating layer 6.

In addition, the auxiliary insulating layers 21 which serve as the rough surface portions can be formed by printing. In addition, since the resin material of the auxiliary insulating layers 21 contains the same material as the material (e.g. Ni) used for the end surface electrodes 8, tight contact properties between the end surface electrodes 8 and the auxiliary insulating layers 21 can be made extremely excellent. Further, since the plating layers 9 are formed of the same material as the material (e.g. Ni) contained in the end surface electrodes 8 and the auxiliary insulating layers 21, not only can tight contact properties between the end surface electrodes 8 and the auxiliary insulating layers 21 be improved, but tight contact properties between the plating layers 9 and the auxiliary insulating layers 21 can be also made extremely excellent.

REFERENCE SIGNS LIST

1, 20 chip resistor
2 insulating substrate

2A aggregate substrate
2B strip-shaped substrate
3 front electrode
4 resistive element
5 first insulating layer
6 second insulating layer
6*a* rough surface portion
6*b* smooth surface portion
7 back electrode
8 end surface electrode
9 plating layer
10 trimming groove
11 masking
21 auxiliary insulating layer (rough surface portion)

The invention claimed is:

1. A chip resistor comprising: a cuboid-shaped insulating substrate; a pair of front electrodes which are provided on opposite end portions of a front surface of the insulating substrate; a pair of back electrodes which are provided on opposite end portions of a back surface of the insulating substrate; a resistive element which is provided to extend onto the pair of front electrodes; a first insulating layer which is made of a glass material to cover the resistive element; a second insulating layer which is made of a resin material to cover portions of the front electrodes and the first insulating layer; end surface electrodes which are provided to establish electrical continuity between the front electrodes and the back electrodes and which extend beyond boundary positions between the front electrodes and the second insulating layer and up to end portions of the second insulating layer; and plating layers which are provided to cover the end surface electrodes and which extend beyond boundary positions between the end surface electrodes and the second insulating layer and up to the end portions of the second insulating layer, a trimming groove being formed in the resistive element and the first insulating layer so that a resistive value of the chip resistor can be adjusted; wherein:

rough surface portions made rougher in surface roughness than any other portion of the second insulating layer are provided at opposite end portions of the second insulating layer positioned on outer sides of the trimming groove; and end portions of the end surface electrodes and the plating layers are in tight contact with the rough surface portions respectively.

2. A chip resistor according to claim 1, wherein: the rough surface portions are formed by blast treatment applied to the second insulating layer.

3. A chip resistor according to claim 1, wherein: auxiliary insulating layers made rougher in surface roughness than the second insulating layer are provided on the opposite end portions of the second insulating layer, and the rough surface portions are formed by the auxiliary insulating layers.

4. A chip resistor according to claim 3, wherein: a resin material of the auxiliary insulating layers contains the same material as a material used for the end surface electrodes.

5. A chip resistor according to claim 4, wherein: the plating layers are formed of the same material as the material contained in the end surface electrodes and the auxiliary insulating layers.

* * * * *